US005520959A

United States Patent [19]

Tanaka et al.

[11] Patent Number: 5,520,959

[45] Date of Patent: May 28, 1996

[54] SURFACE-TREATMENT METHOD FOR TIN-PLATED DRAWN AND IRONED CANS

[75] Inventors: Shigeo Tanaka; Tomoyuki Aoki; Masayuki Yoshida, all of Kanagawa-Ken, Japan

[73] Assignee: Henkel Corporation, Plymouth Meeting, Pa.

[21] Appl. No.: 910,081

[22] PCT Filed: Jan. 1, 1991

[86] PCT No.: PCT/US91/00202

§ 371 Date: Jul. 10, 1992

§ 102(e) Date: Jul. 10, 1992

[87] PCT Pub. No.: WO91/10756

PCT Pub. Date: Jul. 25, 1991

[30] Foreign Application Priority Data

Jan. 10, 1990 [JP] Japan ..... 2-3200

[51] Int. Cl.[6] ..... B05D 3/02

[52] U.S. Cl. ..... 427/354; 427/388.4; 427/405; 427/409; 427/421

[58] Field of Search ..... 427/388.1, 388.4, 427/354, 405, 409, 421

[56] References Cited

U.S. PATENT DOCUMENTS 4,080,318 3/1978 Smith et al. ..... 528/68 X
4,517,028 5/1985 Lindert ..... 252/389.23 X

*Primary Examiner*—Michael Lusignan
*Attorney, Agent, or Firm*—Wayne C. Jaeschke; Norvell E. Wisdom, Jr.; Julie R. Keller

[57] ABSTRACT

A surface which has excellent adhesivity to paint, good corrosion resistance, and low friction may be obtained on drawn and iron tin plated cans by spraying the can surface for a time between 5 and 60 seconds at a temperature between 40° and 60° C. with an aqueous treating liquid having a pH between 4 and 6 and comprising (i) orthophosphoric acid and/or condensed phosphoric acids and (ii) a concentration of at least 0.1 w/o of a water soluble oligomer according to the general formula:

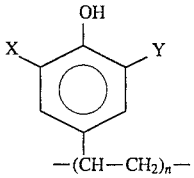

wherein n is a number with a value between 10 and 30 and each of X and Y independently represents hydrogen or a group Z, wherein Z has a chemical composition conforming to the general formula:

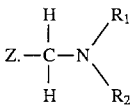

wherein each of $R_1$ and $R_2$ is an alkyl or hydroxyalkyl group having from 1 to 5 carbon atoms, except that at least 25% of the total of all the X and Y groups in the oligomer are Z rather than hydrogen; and drying the surface thus sprayed, optionally after having first rinsed the sprayed surface with water.

20 Claims, No Drawings

SURFACE-TREATMENT METHOD FOR TIN-PLATED DRAWN AND IRONED CANS

TECHNICAL FIELD

The present invention relates to a novel surface treatment method for tin plated drawn and ironed cans, i.e., can formed by the drawing and ironing of tin plated steel sheet. The method imparts excellent corrosion resistance and paint adhesivity to the surface of the can prior to its being painted or printed, and also imparts the excellent slideability (low frictional resistance) that is required for smooth transport of the can by automatic conveying equipment, particularly modern high speed conveying equipment.

BACKGROUND ART

The invention of Japanese Patent Application Laid Open [Kokai or Unexamined] Number 1-100281 [100,281/89] is an example of a surface treatment liquid for tin plated DI cans. This teaching of the prior art employs a film forming liquid for the treatment of metal surfaces. This solution has a pH of 2 to 6 and contains 1 to 50 grams per liter ("g/L") of phosphate, 0.2 to 20.0 g/L of oxyacid ions, 0.01 to 5.0 g/L of tin ions, and 0.01 to 5.0 g/L of condensed phosphate. Treatment with this conversion treatment solution afforded a highly corrosion resistant phosphate film on the surface of tin-plated DI cans.

However, in recent years tin-plated DI cans have been produced using low levels of tin plating in response to economic considerations, and this has required that its surface treatment provide far more corrosion resistance than before. Moreover, when treatment is conducted by prior methods, in some cases the gloss of the base metal is degraded due to etching of the base metal. Accordingly, there is a demand for a surface treatment which does not damage the external appearance by reducing the gloss.

Treatment methods intended to provide corrosion resistance and adhesivity through the use of water soluble resin are exemplified by the invention in Japanese Patent Application Laid Open Number 1-172406 [172,406/89]. This invention provided as an example of the prior art comprises a method in which the metal surface is treated with a solution which contains an effective derivative of a polyhydric phenol compound. However, the disclosed method does not generate a satisfactorily stable corrosion resistance.

In addition, the metal can manufacturing process often suffers from a problem with transfer or transport: the slideability of the outer surface of the can during conveyor transport of the can may be poor due to a high friction coefficient of the outer surface, so that the can may be tipped over sideways. Can transport to the printer in the most modern high speed can lines is a particular problem in this regard. Accordingly, there is demand in the can manufacturing industry for a reduction in the static friction coefficient of the outer surface of cans, which at the same time does not cause any adverse effects on the adhesion of any paint or lacquer subsequently coated on the can. The invention of Japanese Patent Application Laid Open Number 64-85292 [85,292/89] comprises a method for improving this slideability. The reference teaches a surface treatment composition for metal cans which contains water-soluble organic material selected from phosphate esters, alcohols, monobasic, and polybasic fatty acids, fatty acid derivatives, and mixtures of the foregoing. While the disclosed method does in fact generate an increase in the slideability, it does not improve the corrosion resistance or paint adhesion.

U.S. Pat. No. 4,517,028 teaches in general terms treatment of metals with aminated derivatives of poly(vinyl phenols). This reference, however, makes no specific reference to treating tin plate or DI cans.

DESCRIPTION OF THE INVENTION

Problem to Be Solved by the Invention

The principal goal of the invention is to provide a single treatment for drawn or ironed cans that will result in increased corrosion resistance, good adhesion to subsequently applied paint or similar organic coatings, and a low coefficient of friction on the outside can surface, for efficient processing in automated can processing lines using high speed conveyors and printers.

SUMMARY OF THE INVENTION

It was discovered that a film with excellent corrosion resistance, paint adhesion, and slideability could be formed on at least one surface of drawn and ironed can, by controlling the conditions of treating the surface as follows:

(1) A liquid treating composition is prepared by dissolving in water an oligomer having a chemical composition specified by the general formula:

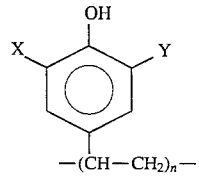

wherein n is a number with a value between 10 and 30 and each of X and Y independently represents hydrogen or a group Z, wherein Z has a chemical composition conforming to the general formula:

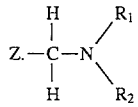

wherein each of $R_1$ and $R_2$ is an alkyl or hydroxyalkyl group having from 1 to 5 carbon atoms, except that at least 25% of the total of all the X and Y groups in the oligomer are Z rather than hydrogen.

(2) The pH of the surface treatment solution containing the oligomer described in item (1) is adjusted to a value between 4 to 6 by the addition of orthophosphoric acid and/or condensed phosphoric acid.

(3) The surface treatment liquid as prepared in step (2) is heated to a temperature of at least 40 but preferably to not more than 60 degrees Centigrade and the heated surface treatment liquid is then sprayed on the cleaned surface of tin plated drawn and ironed can for a time of at least 5 and preferably not more than 60 seconds.

(4) The aforesaid spray treatment is followed by thermal drying or by a water rinse and then thermal drying.

Preferably, there is no water rinse before drying after contact of the surface of the drawn and ironed can with the heated surface treatment liquid as specified above. If there is water rinsing before drying, it is preferred that at least the last such water rinse be with deionized or other purified water substantially free from dissolved solids. It there is no rinsing with water before drying, it is normally preferred to let the sprayed cans drain under the influence of gravity, and/or to remove some of the liquid from the can surface by mechanical means such as an air flow, rollers under slight pressure, or the like, to avoid the presence of excessive amounts of the surface treatment liquid on the surface during drying.

DETAILS OF PREFERRED EMBODIMENTS OF THE INVENTION

The value of n in the general formula given above for the oligomer dissolved in the surface treatment liquid is 10 to 30. At values of n below 10, little or no improvement in corrosion resistance will be observed on drawn and ironed tin plated cans. A value of 31 or more for n results in a poorly stable aqueous solution which cannot readily be used in practical applications.

In the general formula for group Z, $R_1$ and $R_2$ represent alkyl or hydroxyalkyl groups having 1 to 5 carbon atoms. When they contain six or more carbons, the stability of the aqueous solution is reduced. The introduction ratio for the group Z should be 25 to 100 mole % referred to the total number of X and Y groups in the oligomer. The water solubility of the oligomer may not be adequate when over 75% of the total of X and Y groups present are hydrogen.

The oligomer solids content in the treatment liquid preferably is from 0.1 to 0.5% by weight of the total liquid. Below 0.1% by weight it is very difficult to form a stable film on a drawn and ironed tin can surface. On the other hand, the treatment solution is costly above 0.5% by weight with little or no additional technical benefit.

The pH of the treatment solution should be adjusted to 4 to 6 through the use of orthophosphoric acid and/or a condensed phosphoric acid such as pyrophosphoric acid. Substantial etching of the can surface occurs at a pH below 4 and impairs film formation. At a pH above 6, the solution has a short life because the oligomer tends to precipitate and sediment. The pH can normally be adjusted into the range of 4 to 6 by the addition of 0.05 to 0.3 by weight orthophosphoric acid or 0.03 to 0.2% by weight pyrophosphoric acid referred to the total surface treatment liquid. Other condensed phosphoric acids and mixtures of condensed acids or of condensed and orthophosphoric acids can also be used.

In addition, the treatment liquid should be heated to at least 40 degrees Centigrade during use. The treatment liquid is poorly reactive below 40 degrees Centigrade, and this works against the formation of a highly corrosion resistant film. On the other hand, little or no benefit due to heating is observed when the liquid is heated to above 60 degrees Centigrade, and unnecessary heating is expensive.

The spraying time should be at least 5 seconds. Only an inadequate reaction is obtained at less than 5 seconds, and a strongly corrosion resistant film is not developed. On the other hand, treatment times in excess of 60 seconds do not afford any increase in performance and increase the expense.

The surface treatment method of the present invention is described below through several illustrative examples of particularly preferred embodiments of the invention, and its usefulness will be demonstrated by comparison with comparison examples. The examples are not to be regarded as limiting the invention, except in so far as noted in the claims.

GENERAL CONDITIONS FOR EXAMPLES

A small sprayer was used for the degreasing and surface treatment of the cans. This small sprayer was designed to give spray conditions identical to those encountered in spray treatment with the can washers which are currently in use in the can manufacturing industry.

The corrosion resistance of a treated can was evaluated through the iron exposure value ("IEV"), which was measured according to the directions in U.S. Pat. No. 4,332,646. The corrosion resistance is better at lower IEV values.

The paint adhesiveness was evaluated as follows: an epoxy-urea can paint was coated to a film thickness of 5 to 7 micrometers (microns) on the surface of the treated can, which was subsequently baked for 4 minutes at 215 degrees Centigrade; the can was then cut into a 5×150 millimeter ("mm") strip, onto which was hot-pressed polyamide film in order to afford a test specimen; and this was then peeled in a 180° peel test to give the peel strength. Higher peel strength values correspond to a better adhesiveness.

The slideability of treated cans was evaluated by measurement of the coefficient of static friction of the outer surface of the can. Values of this coefficient of static friction of less than or equal to 0.9 are preferred, while values within the range of 0.7 to 0.8 are particularly preferred.

The oligomer used in all the examples below according to the invention had the average general formula:

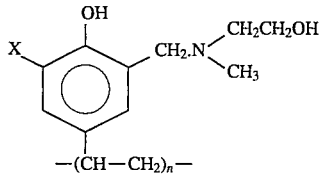

wherein n had an average value of 20 and X represented hydrogen. This oligomer was synthesized as follows: 100 grams ("g") of Cellosolve™ solvent (the monoethyl ether of ethylene glycol) was introduced into a 1 liter reaction flask equipped with a condenser, nitrogen inlet tube, overhead stirrer, and thermometer, and 60 g of poly(4-vinyl phenol) with an average molecular weight of 2,500 was added and dissolved; 40 grams of 2-methylamino ethanol and 100 g of deionized water were added, and the contents of the flask were heated to 50 degrees Centrigrade; 40 g of 37% formaldehyde solution in water was added over 1 hour, followed by stirring at 50 degrees Centigrade for 2 hours and by further heating to 80 degrees Centigrade and stirring for an additional 3 hours at that temperature; the reaction product was cooled, 15 g of 85% orthophosphoric acid was added, and 700 g of deionized water was also added. After reaction with these added ingredients, the oligomer was precipitated by the addition of 10% sodium hydroxide solution until the pH reached 8 to 9. The precipitated oligomer was then filtered off, washed with water, and dried to afford the oligomer used.

EXAMPLE 1

Tin plated steel sheet was drawn and ironed to afford tin plated drawn and ironed cans, which were spray-rinsed with a hot 1% aqueous solution of a weakly alkaline degreaser (FINE CLEANER™ 4361A from Nihon Parkerizing Company, Limited, Tokyo) and then rinsed with water. Cans were then sprayed for 40 seconds with surface treatment liquid 1 (described below), heated to 50 degrees Centigrade, followed by a wash with tap water, than a 10 second spray with deionized water (with a specific resistance of at least 3,000,000 ohm.cm), then drying for 3 minutes in a hot air dryer at 180 degrees Centigrade. Surface-treatment liquid 1 had the following composition:

| | |
|---|---|
| oligomer solids | 0.2 weight % |
| 75% orthophosphoric acid | 0.1 weight % |
| water | 99.7 weight % |
| pH | 5.5 |

EXAMPLE 2

Tin plated drawn and ironed cans were cleaned as in Example 1, then spray treated for 40 seconds with surface treatment liquid 2, heated to 50 degrees Centigrade. This was followed by a water wash and drying as in Example 1. The composition of surface treatment liquid 2 was:

| | |
|---|---|
| oligomer solids | 0.2 weight % |
| 50% pyrophosphoric acid | 0.1 weight % |
| water | 99.7 weight % |
| pH | 5.5 |

The oligomer used was the same as in Example 1.

EXAMPLE 3

Tin plated drawn and ironed cans were cleaned as in Example 1, then spray treated for 10 seconds with the above described surface treatment liquid 1 (cf. Example 1), which had been heated to 50 degrees Centigrade. This was followed by a water wash and drying as in Example 1.

EXAMPLE 4

Tin plated drawn and ironed cans was cleaned as in Example 1, then spray treated for 40 seconds with the above described surface treatment liquid 1 (cf. Example 1), which had been heated to 50 degrees Centigrade. This was followed by draining, without water rinsing, and then drying in a hot air dryer at 180 degrees Centigrade for 3 minutes.

COMPARISON EXAMPLE 1

Tin plated drawn and ironed cans were cleaned as in Example 1, then spray treated for 40 seconds with comparison surface treatment liquid 1, heated to 50 degrees Centigrade, then washed with water and dried as in Example 1. Comparison surface treatment liquid 1 had the following composition:

| | |
|---|---|
| oligomer solids | 0.2 weight % |
| 75% orthophosphoric acid | 1.5 weight % |
| water | 98.3 weight % |
| pH | 2.0 |

The oligomer used was the same as in Example 1.

COMPARISON EXAMPLE 2

Tin plated drawn and ironed cans were cleaned as in Example 1, then spray treated for 2 seconds with the above described surface treatment liquid 1 (cf. Example 1), which had been heated to 50 degrees Centigrade, then washed with water and dried as in Example 1.

COMPARISON EXAMPLE 3

Tin plated drawn and ironed cans were cleaned as in Example 1, then spray treated for 40 seconds with the Comparison surface treatment liquid 2, heated to 50 degrees Centigrade, then washed with water and dried as in Example 1. The composition of Comparison surface treatment liquid 2 was:

| | |
|---|---|
| oligomer solids | 0.2 weight % |
| 70% orthophosphoric acid | 0.1 weight % |
| water | 99.7 weight % |
| pH | 5.5 |

The oligomer used for Comparison surface treatment liquid 2 was not the same as that used for the Examples and the preceding Comparison examples, but instead had the approximate formula:

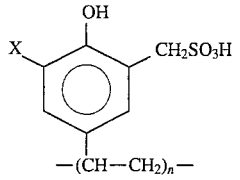

wherein has an average value of 20 and X represents hydrogen. This oligomer was synthesized as follows: 100 g of poly(4-vinylphenol) (average molecular weight=2,500) was charged to a 1 liter reaction flask equipped with a condenser, nitrogen inlet tube, overhead stirrer, and thermometer, and it was then dissolved by the addition of 500 g of 1,4-dioxane. This solution was maintained at approximately 10 degrees Centigrade, and 80 g of liquid sulfur trioxide ($SO_3$) was added over 1 hour. This was followed by heating to 80 degrees Centrigrade and reaction for 4 hours with stirring. Neutralization with 10% sodium hydroxide solution and removal of the solvent by distillation afforded the oligomer used above.

Table 1 reports the results of the Examples and Comparison Examples, which confirm an excellent corrosion resistance, adhesiveness, and slideability for the conditions according to the present invention and superiority over all the Comparison Examples. Thus, treatment of DI tin cans according to the present invention provides an excellent corrosion resistance and paint adhesion to the surface of tin plated cans and also imparts the excellent slideability that is required for a smooth conveyor transport of the cans.

TABLE 1

TEST RESULTS OF THE EXAMPLES AND COMPARISON EXAMPLES

| | IEV | Peel Strength, Kg Force/5 mm Width | Coefficient of Friction |
|---|---|---|---|
| Example 1 | 100 | 2.0 | 0.8 |
| Example 2 | 100 | 2.0 | 0.8 |
| Example 3 | 100 | 2.0 | 0.8 |
| Example 4 | 40 | 2.0 | 0.7 |
| Comparison Example 1 | 350 | 1.5 | 1.0 |
| Comparison Example 2 | 550 | 1.7 | 1.0 |
| Comparison Example 3 | 700 | 1.5 | 1.0 |

We claim:

1. A method for treating at least the outer surface of a tin plated drawn and ironed can formed by drawing and ironing of tin-plated steel, wherein the precleaned surface to be treated is sprayed for at least 5 seconds at a temperature of at least 40° C. with an aqueous surface treatment liquid having a pH between 4 and 6 and comprising (i) 0.03 to 0.3 percent by weight of acids selected from the group consisting of orthophosphoric acid and condensed phosphoric acids and (ii) a concentration of at least 0.1 percent by weight of a water soluble oligomer according to the general formula:

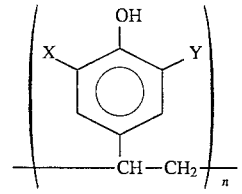

wherein n is a number with a value between 10 and 30 and each of X and Y independently represents hydrogen or a group Z, wherein Z has a chemical composition conforming to the general formula:

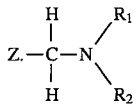

wherein each of $R_1$ and $R_2$ is an alkyl or hydroalkyl group having from 1 to 5 carbon atoms, except that at least 25% of the total of all the X and Y groups in the oligomer are Z rather than hydrogen; and drying the surface thus sprayed, optionally after having first rinsed the sprayed surface with water.

2. A method according to claim 1, wherein the concentration of oligomer in the aqueous surface treatment liquid is not more than 0.5 percent by weight.

3. A method according to claim 2, wherein the time of spraying is not more than 60 seconds.

4. A method according to claim 1, wherein the time of spraying is not more than 60 seconds.

5. A method according to claim 4, wherein the water soluble oligomer has a chemical structure according to the formula:

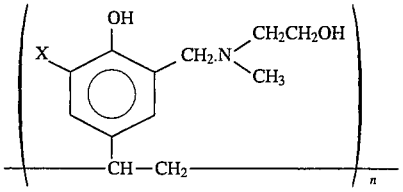

wherein n has an average value of 20 and X represents hydrogen.

6. A method according to claim 4, wherein the sprayed can surface is not rinsed with water before drying.

7. A method according to claim 6, wherein the water soluble oligomer has a chemical structure according to the formula

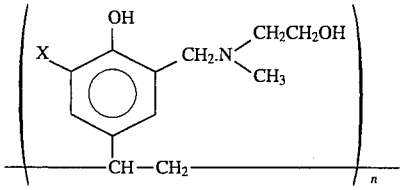

wherein n has an average value of 20 and X represents hydrogen.

8. A method according to claim 4 wherein the sprayed can surface is rinsed with deionized water as the last step before drying.

9. A method according to claim 8, wherein the water soluble oligomer has a chemical structure according to the formula:

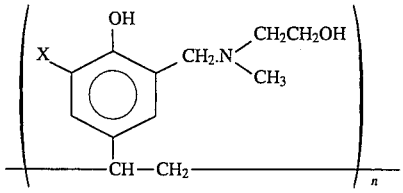

wherein n has an average value of 20 and X represents hydrogen.

10. A method according to claim 3, wherein the water soluble oligomer has a chemical structure according to the formula:

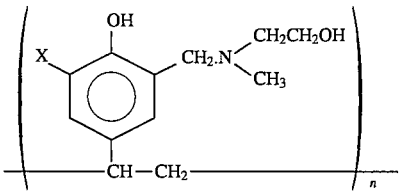

wherein n has an average value of 20 and X represented hydrogen.

11. A method according to claim 10, wherein the sprayed can surface is rinsed with deionized water as the last step before drying.

12. A method according to claim 10, wherein the sprayed can surface is not rinsed with water before drying.

13. A method according to claim 2, wherein the water soluble oligomer has a chemical structure according to the formula:

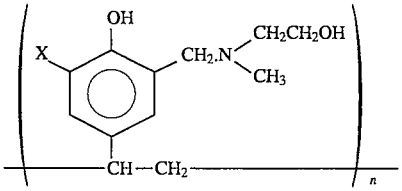

wherein n has an average value of 20 and X represents hydrogen.

14. A method according to claim 10, wherein the sprayed can surface is rinsed with deionized water as the last step before drying.

15. A method according to claim 10, wherein the sprayed can surface is not rinsed with water before drying.

16. A method according to claim 1, wherein the water soluble oligomer has a chemical structure according to the formula:

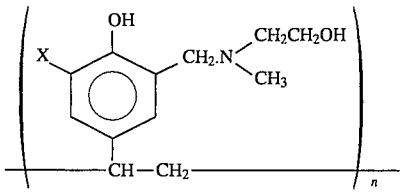

17. A method according to claim 16, wherein the sprayed can surface is rinsed with deionized water as the last step before drying.

18. A method according to claim 16, wherein the sprayed can surface is not rinsed with water before drying.

19. A method according to claim 10, wherein the sprayed can surface is rinsed with deionized water as the last step before drying.

20. A method according to claim 5, wherein the sprayed can surface is not rinsed with water before drying.

* * * * *